US012357076B2

(12) United States Patent
Joung

(10) Patent No.: US 12,357,076 B2
(45) Date of Patent: Jul. 15, 2025

(54) STICK-TYPE COSMETIC CONTAINER

(71) Applicant: Jae Yong Joung, Anyang (KR)

(72) Inventor: Jae Yong Joung, Anyang (KR)

( * ) Notice: Subject to any disclaimer, the term of this patent is extended or adjusted under 35 U.S.C. 154(b) by 447 days.

(21) Appl. No.: 17/795,517

(22) PCT Filed: Jan. 22, 2021

(86) PCT No.: PCT/KR2021/000900

§ 371 (c)(1),
(2) Date: Jul. 26, 2022

(87) PCT Pub. No.: WO2021/153949

PCT Pub. Date: Aug. 5, 2021

(65) Prior Publication Data

US 2023/0082742 A1 Mar. 16, 2023

(30) Foreign Application Priority Data

Jan. 29, 2020 (KR) ..... 10-2020-0010503
Dec. 28, 2020 (KR) ..... 10-2020-0185183

(51) Int. Cl.

| | |
|---|---|
| ***A45D 40/18*** | (2006.01) |
| ***A45D 40/06*** | (2006.01) |
| ***A45D 40/14*** | (2006.01) |
| ***B65D 83/761*** | (2025.01) |

(52) U.S. Cl.

CPC ..... *A45D 40/18* (2013.01); *A45D 40/06* (2013.01); *B65D 83/761* (2025.01); *A45D 2200/1009* (2013.01)

(58) Field of Classification Search

CPC .. A45D 40/18; A45D 40/06; A45D 200/1009; A45D 40/00; A45D 2040/0006; A45D 40/02; A45D 40/04; A45D 40/14; A45D 40/205; A45D 2040/208; B65D 83/0011; B65D 83/0005; B65D 83/761

USPC ..... 401/68, 75, 76, 77, 87, 88, 171–174

See application file for complete search history.

(56) References Cited

U.S. PATENT DOCUMENTS

| | | | | |
|---|---|---|---|---|
| 2,264,482 A * | 12/1941 | Ridner, Sr. | ..... | A45D 40/28 D28/86 |
| 11,076,679 B1 * | 8/2021 | Chung | ..... | A45D 40/06 |
| 2023/0107286 A1 * | 4/2023 | Lee | ..... | A45D 40/06 401/78 |

(Continued)

FOREIGN PATENT DOCUMENTS

| | | |
|---|---|---|
| JP | 2007-511272 A | 5/2007 |
| JP | 2016-077781 A | 5/2016 |
| JP | 2019-097824 A | 6/2019 |

(Continued)

*Primary Examiner* — David J Walczak

(74) *Attorney, Agent, or Firm* — Heedong Chae; Lucem, PC

(57) ABSTRACT

A stick-type cosmetic container comprises: a main body; a rotary body which is rotatably coupled to the main body and which has a rotary screw thread formed thereon; an elevation member, which is coupled to the inner side of the main body and rises, includes a stick cosmetic, and has an elevation screw thread; a remaining-amount withdrawal member which is coupled to the elevation member so as to push the stick cosmetic outward, and which has a screw protrusion; and an elastic member provided between the elevation member and the remaining-amount withdrawal member.

9 Claims, 11 Drawing Sheets

(56) References Cited

U.S. PATENT DOCUMENTS

2023/0180916 A1* 6/2023 Byeon ..... A45D 40/06
401/108

FOREIGN PATENT DOCUMENTS

KR 20-1999-0006559 U 2/1999
KR 10-1625329 B1 5/2016

* cited by examiner

STICK-TYPE COSMETIC CONTAINER

TECHNICAL FIELD

One aspect of the present disclosure relates to a stick-type cosmetic container, and more specifically, to a stick-type cosmetic container which can use all stick cosmetics without the remaining amount of stick cosmetics through the operation of an elevation member to which the stick cosmetics are attached and a remaining-amount withdrawal member for pushing the stick cosmetics remaining in the elevation member to the outside.

BACKGROUND ART

In general, women use various cosmetics to make their appearance more beautiful. Among the cosmetics, color cosmetics are used for the purpose of creating the beautiful appearance to make the skin beautiful.

The color cosmetics are classified into a base makeup used for making a skin color uniform and capping a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is a cosmetic that is used to naturally cover skin blemishes, freckles, and the like which are exposed to an outside, such as a face, or to express clean and bright skin or clear and soft skin. When applying makeup using the foundation, the foundation is applied to the skin with a cosmetic puff and spread evenly without balling.

The foundation is generally stored in a wide and flat compact container, and a puff is kept inside the compact container.

However, in order to use the foundation contained in the compact container, the user opens the container lid, grabs the puff contained in an upper portion of the container lid, and then opens the container lid. However, it is inconvenient to use because the cosmetics need to be applied to the skin by dipping the foundation cosmetics with the puff. In addition, the foundation cosmetics remaining in the puff in this process may be attached to the user's hands, causing the user's hands to be smeared.

Accordingly, for convenience of use and convenience of carrying and storing, a stick-type cosmetic container has been developed in which stick-type cosmetics are mounted on one side of the container, and the stick-type cosmetics mounted inside the container are moved up and down by rotating the container.

A conventional stick-type cosmetic container (Korean Registered Utility Model Publication No. 20-0393382 entitled 'Stick-type cosmetic container') having such a structure is as follows.

The conventional technique includes a housing, a lower cap coupled to the lower portion of the housing and having a screw-type elevating guide hole, an operating member that moves up and down according to the rotation of the lower cap, a containing member to which stick-type cosmetics are attached and which moves up and down together with the operating member, a protective tube that supports the up-down movement of the containing member and stores stick-type cosmetics, and an upper cap that seals the protective tube. Thus, the stick-type cosmetics appear and disappear from the protective tube as the housing is rotated while the protective tube is gripped.

However, the conventional stick-type cosmetic container has a problem in that resources are wasted because all of the stick-type cosmetics remaining in the container member cannot be used and there is an inconvenience in that it is necessary to use a separate tool to forcibly take out the cosmetics in order to use the stick-type cosmetics remaining in the container member.

In order to solve the above problem, a lipstick container is disclosed in Korean Registered Utility Model No. 20-0484721 (hereinafter referred to as 'related art').

The related art includes a rotary tube formed with a vertical guide groove from the upper end to the lower portion thereof, a spiral tube rotatably fixed to the rotary tube and formed therein with a spiral groove, a lipstick holder that is inserted into the spiral groove of the spiral tube and moves up and down according to the rotation of the rotary tube, and a remaining-amount withdrawal knob that serves to withdraw the lower end of the lipstick upward, thereby allowing a user to completely use the lipstick without leaving residues.

However, the related art has a structure in which the lipstick is moved up and down by the rotation of the rotary tube, and the remaining amount of the lipstick is withdrawn to the outside from the lipstick holder by the rotation of the remaining-amount withdrawal knob coupled to the opposite side of the rotary tube. That is, the up-down movement of the lipstick is manipulated separately from the remaining-amount withdrawal structure of the lipstick, so it is inconvenient in use. In addition, the remaining-amount withdrawal structure of the lipstick is formed separately from the structure of the up-down movement of the lipstick, thereby complicating the structure of the container, and thus productivity is lowered.

RELATED ART DOCUMENTS

Patent Documents (Patent Document 0001) Korean Registered Utility Model No. 20-0393382 (issued on Aug. 11, 2005) "Stick-Type Cosmetic Container"

(Patent Document 0002) Korean Registered Utility Model No. 20-0484721 (Issued on Oct. 11, 2017) "Lipstick Container"

DISCLOSURE

Technical Problem

In order to solve the above problems, an object of the present disclosure is to provide a stick-type cosmetic container, which allows a user to conveniently use all stick cosmetics by continuously operating an elevation member to which the stick cosmetics are attached and a remaining-amount withdrawal member that pushes the stick cosmetics remaining in the elevation member to the outside by the rotation of a rotary body.

In addition, another object of the present disclosure is to provide a stick-type cosmetic container, in which a remaining-amount withdrawal member coupled to an inside of an elevation member is elastically supported by an elastic member, so that the feeling of operation is improved when withdrawing the remaining amount of the stick cosmetic, and the remaining-amount withdrawal member and the elevation member are undercut coupled to each other, so that a user can easily check the time of withdrawal of the remaining amount of the stick cosmetics.

In addition, another object of the present disclosure is to provide a stick-type cosmetic container, in which an elevation member is screw-coupled with a remaining-amount withdrawal member so that the stick cosmetic in the elevation member is withdrawn to the outside as the remaining-amount withdrawal member moves, thereby stably withdrawing the remaining amount of the stick cosmetic, and a user can recognize the withdrawal operation with naked eyes.

Technical Solution

In order to achieve the above objects, one aspect of the present disclosure provides a stick-type cosmetic container including: a main body; a rotary body which is rotatably coupled to the main body and has a rotary screw thread formed thereon; an elevation member, which is coupled to an inner side of the main body and moves up and down, provided with a stick cosmetic, and formed with an elevation screw thread; and a remaining-amount withdrawal member which is coupled to the elevation member so as to push the stick cosmetic outward, and formed with a screw protrusion.

In addition, a fixing groove may be formed in the main body, and a fixing protrusion may be formed in the elevation member so that the fixing protrusion is inserted into the fixing groove.

In addition, the elevation member may include a plate portion to which the stick cosmetic is attached and a screw coupling portion screw-coupled to the rotary body, and a stopper protrusion may protrude from an inside of the plate portion to limit a movement of the remaining-amount withdrawal member.

In addition, the remaining-amount withdrawal member may include a withdrawal portion provided with a withdrawal plate to push the stick cosmetic to an outside and an operation portion for moving the withdrawal portion within the elevation member.

In addition, an elastic member may be installed between the elevation member and the remaining-amount withdrawal member, and the elastic member may come in close contact with an end of the elevation member while surrounding at least a portion of the remaining-amount withdrawal member to provide elasticity between the elevation member and the remaining-amount withdrawal member.

In addition, a first screw thread may be formed on an inner periphery of the elevation member, a second screw thread may be formed on an outer periphery of the remaining-amount withdrawal member, and the first screw thread may be screw-coupled with the second screw thread so that the remaining-amount withdrawal member moves along an inside of the elevation member.

In addition, the withdrawal portion and the operation portion of the remaining-amount withdrawal member may be formed separately from each other and coupled to each other, and a first control protrusion and a second control protrusion may be formed at portions where the withdrawal portion makes contact with the operation portion, respectively, and may be engaged with each other.

In addition, a cosmetic application tool may be further coupled to an opposite side of the main body about the rotary body.

Advantageous Effects

According to one aspect of the present disclosure, the operation of the elevation member to which the stick cosmetics are attached can be performed continuously with the operation of the remaining-amount withdrawal member that pushes the stick cosmetics remaining in the elevation member to the outside by the rotation of the rotary body, thereby allowing a user to conveniently use all stick cosmetics.

According to one aspect of the present disclosure, the remaining-amount withdrawal member coupled to an inside of the elevation member can be elastically supported by an elastic member, so that the feeling of operation can be improved when withdrawing the remaining amount of the stick cosmetic, and the remaining-amount withdrawal member and the elevation member can be undercut coupled to each other, so that a user can easily check the time of withdrawal of the remaining amount of the stick cosmetics.

According to one aspect of the present disclosure, the elevation member can be screw-coupled with the remaining-amount withdrawal member so that the stick cosmetic in the elevation member can be withdrawn to the outside as the remaining-amount withdrawal member moves, thereby stably withdrawing the remaining amount of the stick cosmetic, and a user can recognize the withdrawal operation with naked eyes.

BEST MODE

Mode for Invention

Figure 1:
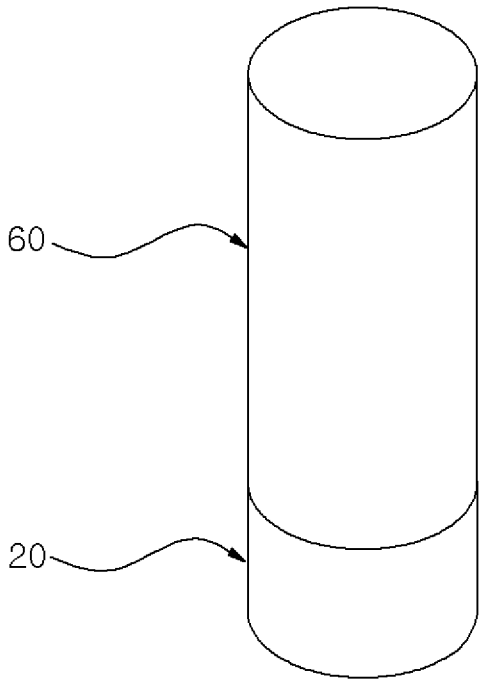
FIG. 1 is a perspective view of a stick-type cosmetic container according to one aspect of the present disclosure.

Hereinafter, the detailed descriptions of the present disclosure are embodiments for carrying out the present disclosure, and the corresponding embodiment refers to the accompanying drawings as an example. The embodiments will be described in detail to enable those skilled in the art to carry out the present disclosure. It is apparent to be understood that the various embodiments of the present disclosure may be different from each other but do not need to be mutually exclusive. For example, the particular shape, structure, and feature described herein may be embodied in other embodiments without departing from the idea and scope of the present disclosure in connection with the embodiment. Further, it shall be understood that the location or arrangement of an individual element within each disclosed embodiment may be modified without departing from the idea and scope of the present disclosure.

Accordingly, the following detailed description does not disclose a limited meaning, and the scope of the disclosure is limited only by the appended claims, along with the full scope of equivalents to which the claims are entitled, if properly explained. Similar reference numerals in the drawings refer to the same or similar function throughout several aspects.

General terms widely used recently have been selected in the present disclosure in consideration of functions according to the present disclosure as possible, however, the terms may vary depending on the intention of those skilled in the art, judicial cases, the advent of new technology, or the like. In addition, in certain cases, the term may be arbitrarily selected by the applicant, and in this case, the meaning thereof will be described in detail in the relevant description of the disclosure. Therefore, the term used in the present disclosure should be defined based on the meaning of the term and contents throughout the present disclosure, not simply on the name of the term.

When one part "includes" one element in the present disclosure, the above expression does not exclude other elements, but may further include the other elements unless particularly stated otherwise.

Hereinafter, a stick-type cosmetic container according to one aspect of the present disclosure will be described in detail with reference to FIGS. 1 to 7.

Figure 2:
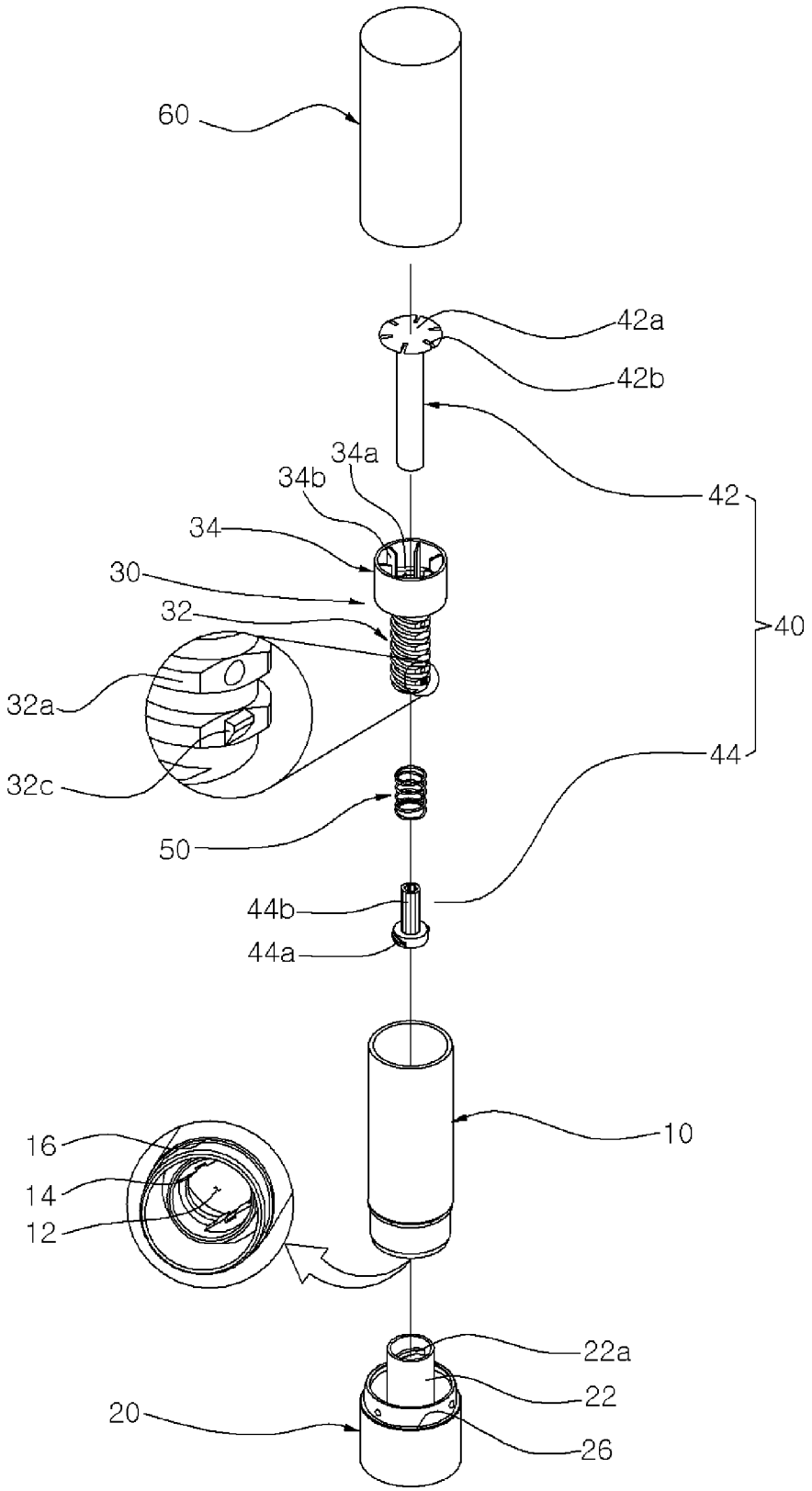
FIG. 2 is an exploded perspective view of a stick-type cosmetic container according to one aspect of the present disclosure.
Figure 3:
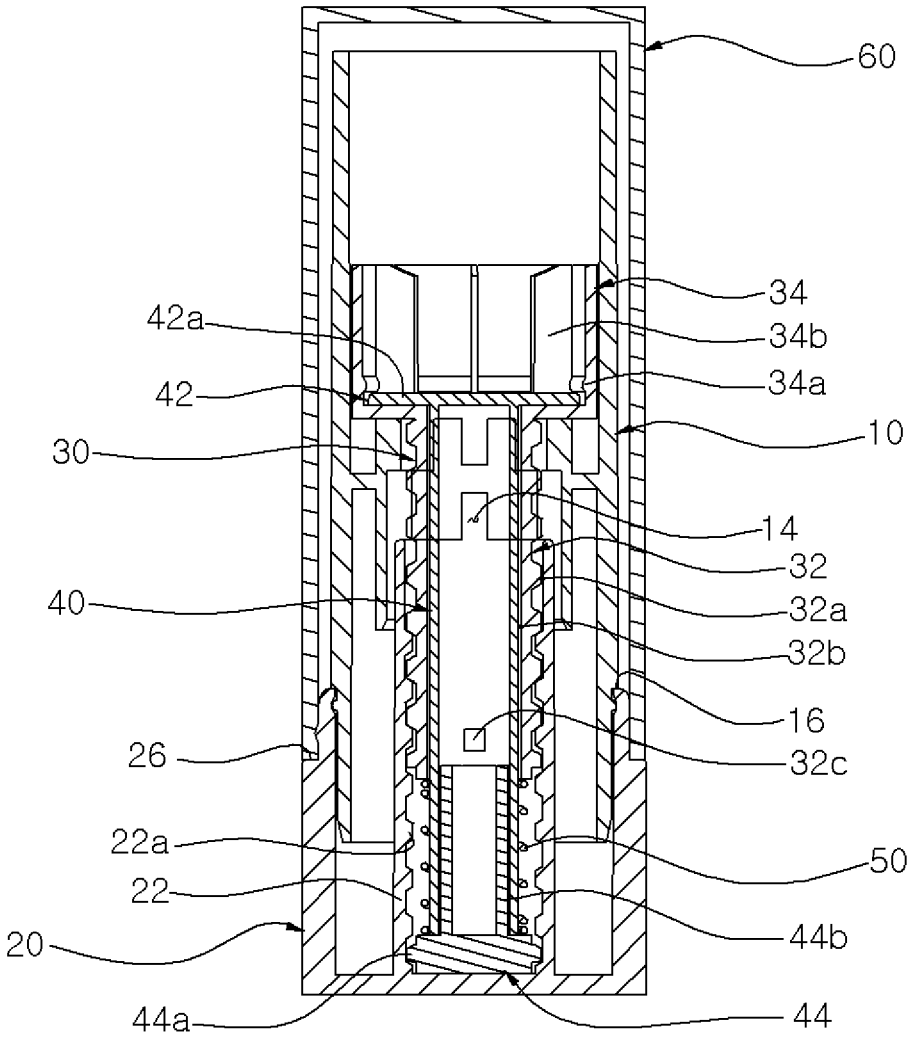
FIG. 3 is a sectional view of a stick-type cosmetic container according to one aspect of the present disclosure.

FIG. 1 is a perspective view of a stick-type cosmetic container according to one aspect of the present disclosure, FIG. 2 is an exploded perspective view of a stick-type cosmetic container according to one aspect of the present disclosure, and FIG. 3 is a sectional view of a stick-type cosmetic container according to one aspect of the present disclosure.

As shown in the drawings, the stick-type cosmetic container according to one aspect of the present disclosure may include a main body 10, a rotary body 20, an elevation member 30, and a remaining-amount withdrawal member 40.

The main body 10 has a cylindrical shape with both open sides, in which the rotary body 20 is coupled to one open side, and the stick cosmetic S passes through the other open side. An elevation member 30 is installed inside the main body 10 to guide the linear movement of the elevation member 30. In the drawings of the stick-type cosmetic container according to one aspect of the present disclosure, the main body 10 is illustrated as to have a rigid cylindrical shape, but the present disclosure is not limited thereto and may be formed with various shapes or materials.

As shown in FIG. 2, an anti-rotation hole 12 may be formed inside the main body 10 to prevent the rotation of the elevation member 30. The elevation member 30 may be coupled through the anti-rotation hole 12 to prevent the elevation member 30 from rotating together with the rotary body 20 when the rotary body 20 is rotated. The anti-rotation hole 12 is preferably formed in a shape having a planar surface on at least one surface thereof or a polygonal or elliptical shape such that the elevation member 30 can be prevented from rotating together with the rotary body 20.

In addition, a fixing groove 14 may be formed in the main body 10. The fixing groove 14 may be formed at a position adjacent to the anti-rotation hole 12 to fix the elevation member 30. That is, when the elevation member 30 moves up to the maximum by the rotation of the rotary body 20, a fixing protrusion 32*c* formed on the elevation member 30 is inserted into the fixing groove 14, so that the elevation member 30 is fixed without escaping from the main body 10.

A main body step 16 may be formed on the outer periphery of the main body 10, and the main body 10 is prevented from being pushed into the rotary body 1020 by the main body step 16 when the main body 10 and the rotary body 20 are coupled to each other.

The rotary body 20 is configured to be held and rotated by the user, and the elevation member 30 and the remaining-amount withdrawal member 40 may move linearly along the main body 10 by the rotation of the rotary body 1020.

The rotary body 20 may be formed in a cylindrical shape with one open side and rotatably coupled to one side of the main body 10. In this case, as a portion of the main body 10 is inserted into the rotary body 20, an outer wall end of the rotary body 20 comes into close contact with the main body step 16 of the main body 10, so that the rotary body 20 is no longer pushed into the main body 10.

As shown in FIG. 3, a coupling portion insertion tube 22 may extend upward from the inside of the rotary body 20, and a rotary screw thread 22*a* may be formed on the inner periphery of the coupling portion insertion tube 22.

In addition, a rotary body step 26 is formed on the outer periphery of the rotary body 20, in which a cover 60 is seated on the rotary body step 26, and fastening structure between the rotary body 20 and the cover 60 may be formed at an upper portion of the rotary body step 26. In the drawing of the stick-type cosmetic container according to one aspect of the present disclosure, the rotary body 20 and the cover 60 are shown as to be fastened by a protrusion and a groove, but the present disclosure is not limited thereto. Various types of fastening structures such as undercut coupling, press fitting coupling, magnetic coupling, etc. may be used so long as the cover 60 can be easily detached from the rotary body 20.

Meanwhile, the cover 60 is coupled to the rotary body 20, and the cover 60 is detachably coupled to the rotary body 20 while surrounding the main body 10.

The elevation member 30 is coupled to the inside of the main body 10 and moved up and down along the longitudinal direction of the main body 10 by the rotation of the rotary body 20 to withdraw the stick cosmetic S to the outside or to insert the same into the main body 10.

As shown in FIG. 2, the elevation member 30 may include a screw coupling portion 32 screw-coupled to the rotary body 20, and a plate portion 34 to which the stick cosmetic S is attached.

The screw coupling portion 32 is formed on one side of the elevation member 30 and inserted into the coupling portion insertion tube 22 of the rotary body 20, and an elevation screw thread 32*a* is formed on the outer periphery of the screw coupling portion 32 and screw-coupled to the rotary screw thread 22*a* of the rotary body 22. A through hole 32*b* through which a remaining-amount withdrawal member 40 passes is formed at the center of the screw coupling portion 32, and the through hole 32*b* may be connected to the inner space of the plate portion 34. Although the drawing of the stick-type cosmetic container according to one aspect of the present disclosure shows that the elevation screw thread 32*a* has a screw thread shape, the present disclosure is not limited thereto and it may be formed in a protrusion shape and coupled to the rotary screw thread 22*a*.

In addition, a fixing protrusion 32*c* may be formed on one side of the outer periphery of the screw coupling portion 32 to fix the elevation member 30 that has been moved up as far as possible from the main body 10. That is, the elevation member 30 is continuously moved up by the rotation of the rotary body 20, and eventually the fixing protrusion 32*c* of the elevation member 30 is inserted into the fixing groove 14 of the main body 10, so that the elevation member 30 is fixed without being separated from the main body 10, and accordingly, the operation of withdrawing the remaining amount of the stick cosmetic S by the rotary body 20 and the remaining-amount withdrawal member 40 becomes possible.

The plate portion 34 may be formed on the opposite side of the screw coupling portion 32, and the stick cosmetic S may be provided in an inner empty space of the plate portion 34. As shown in FIG. 3, a stopper protrusion 34*a* may protrude from the inner periphery of the plate portion 34 to limit the up-down movement of the remaining-amount withdrawal member 40, which will be described below.

In addition, at least one fixing plate 34*b* may be formed on the inner periphery of the plate portion 34 to extend toward the center to increase the adhesion between the plate portion 34 and the stick cosmetic S. In other words, a plurality of fixing plates 34*b* having relatively wide both sides are configured to penetrate into the inside of the stick cosmetic S to increase the contact area between the fixing plate 34*b* and the stick cosmetic S, so that the stick cosmetic S is not easily separated from the plate portion (34). The height of the outer wall of the plate portion 34 or the number or size of the fixing plate 34*b* may be variously changed for the adhesion force between the stick cosmetic S and the plate portion 34 and the stable fixation of the stick cosmetic S.

The remaining-amount withdrawal member 40 may be coupled to the elevation member 30 and linearly moved by the rotation of the rotary body 20 to push the remaining amount of the stick cosmetic S that is left inside the elevation member 30 to the outside.

As shown in FIG. 2, the remaining-amount withdrawal member 40 may include a withdrawal portion 42 provided with a withdrawal plate 42*a* to push the stick cosmetic S to the outside and an operation portion 44 that linearly moves the withdrawal portion 42 within the elevation member 30.

The withdrawal portion 42 and the operation portion 44 may be formed separately or integrally, and preferably, the withdrawal portion 42 and the operation portion 44 are separately injection-molded and coupled to each other for easy assembly with the elevation member 30. The withdrawal portion 42 of the remaining-amount withdrawal member 40 may extend by passing through the through-hole 32*b* of the elevation member 30, and the operation portion 44 may be coupled to the end of the withdrawal portion 42 passing through the through-hole 32*b*.

A withdrawal plate 42*a* having a disc shape is formed at the end of the withdrawal portion 42, in which one side of the withdrawal plate 42*a* is in close contact with the bottom surface of the plate portion 34, and the other surface is in close contact with the end of the stick cosmetic S. The upward movement of the withdrawal plate 42*a* is restricted by the stopper protrusion 34*a* of the plate portion 34. That is, as shown in FIG. 3, the withdrawal plate 42*a* is fixed to the stopper protrusion 34*a* in an undercut coupling state. In this state, when a certain force is applied thereto as the remaining-amount withdrawal member 40 moves upward, the withdrawal plate 42*a* moves over the stopper protrusion 34*a*, and accordingly, the user can recognize with the naked eyes that the remaining amount of the stick cosmetic S that is left inside the plate portion 34 starts to be withdrawn, and the remaining-amount withdrawal member 40 is prevented from idly rotating with respect to the elevating member 30 by the withdrawal plate 42*a*.

As shown in FIG. 2, at least one slit 42*b* may be formed on the edge of the withdrawal plate 42*a*, so that the fixing plate 34*b* of the plate portion 34 can be inserted 10) and coupled thereto. It may be appropriate that the number or depth of the slits 42*b* correspond to the number or size of the fixing plate 34*b*.

A screw protrusion 44*a* may protrude from the outer periphery of the operation portion 44 such that the screw protrusion 44*a* can be screw-coupled to the rotary screw thread 22*a* of the rotary body 20, and a coupling protrusion 44*b* may protrude upward such that the coupling protrusion 44*b* can be fitted to the end of the withdrawal portion 42, that is, to the opposite side of the withdrawal plate 42*a* so as not to idly rotate.

In detail, in a state where the elevation screw thread 32*a* of the elevation member 30 and the screw protrusion 44*a* of the remaining-amount withdrawal member 40 are vertically spaced apart from each other by a predetermined distance, they are screw-coupled together with the rotary screw thread 22*a* of the rotary body 20, so that the elevation member 30 and the remaining-amount withdrawal member 40 are linearly moved along the longitudinal direction of the main body 10 at the same time when the rotary body 20 is rotated, and the elevation member 30 is fixed to the main body 10 while departing from the rotary body 20. At this point, when the rotary body 20 is further rotated, only the remaining-amount withdrawal member 40 moves up by the rotation of the rotary body 20, thereby pushing the remaining amount of the stick cosmetic S that is left in the plate portion 34 of the elevation member 30 to the outside. Accordingly, the operation of the elevation member 30 and the remaining-amount withdrawal member 40 may be continuously performed only by the rotation of the rotary body 20 so that the user can conveniently use all of the remaining amount of the stick cosmetic S.

Meanwhile, an elastic member 50 may be further installed between the elevation member 30 and the remaining-amount withdrawal member 40, and the elastic member 50 may elastically support the remaining-amount withdrawal member 40 from the elevation member 30.

As shown in FIG. 3, the elastic member 50 may come into close contact with the end of the elevation member 30 while surrounding at least a portion of the remaining-amount withdrawal member 40, thereby providing elasticity between the elevation member 30 and the remaining-amount withdrawal member 40. The elastic member 50 preferably includes a coil spring made by twisting a metal or plastic having elasticity in a spiral shape.

In more detail, when only the remaining-amount withdrawal member 40 moves up by the rotation of the rotary body 20 while the elevation member 30 is fixed to the main body 10, the elastic member 50 installed between the elevation member 30 and the remaining-amount withdrawal members 40 is compressed and the remaining-amount withdrawal member 40 moves elastically, so that the operation feeling is improved in the process of withdrawing the remaining amount of the stick cosmetic S.

FIGS. 4 to 7 are views illustrating an operation process of a stick-type cosmetic container according to one aspect of the present disclosure, the process of using a stick-type cosmetic container according to one aspect of the present disclosure will be described with reference to FIGS. 4 to 7.

Figure 4:
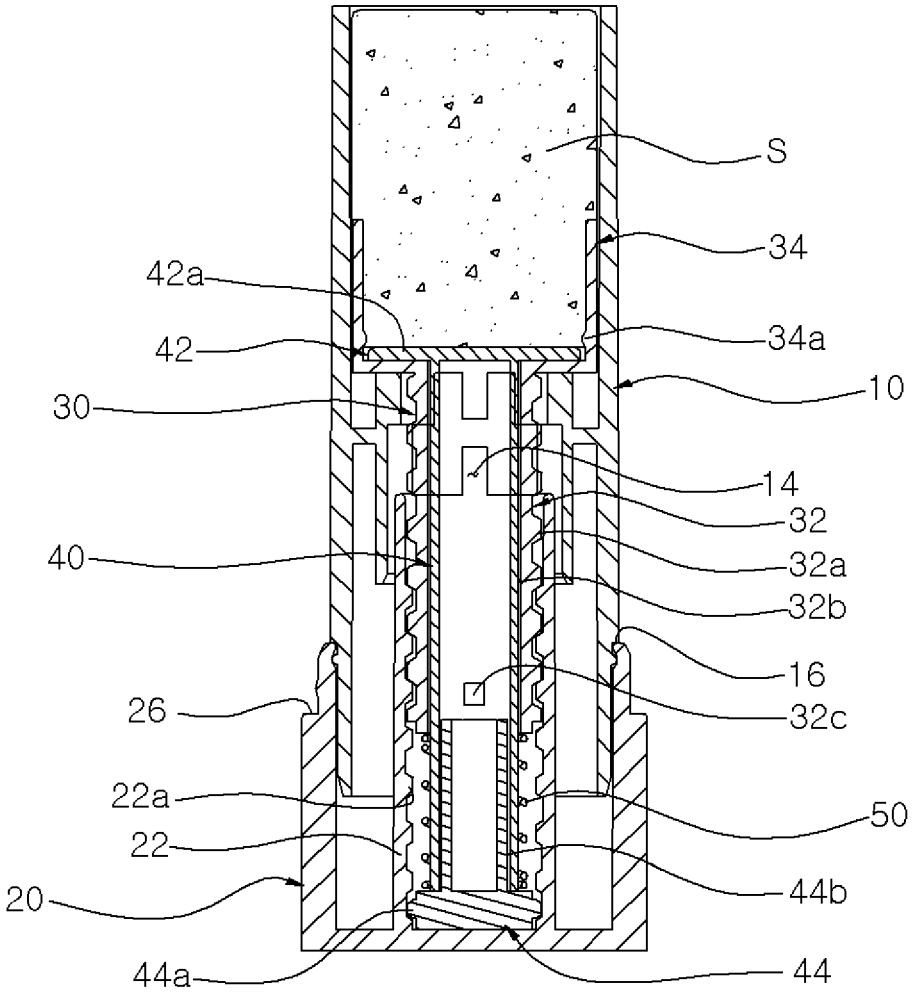
FIG. 4 is a sectional view illustrating a state in which a cover is separated from a rotary body according to one aspect of the present disclosure.
Figure 5:
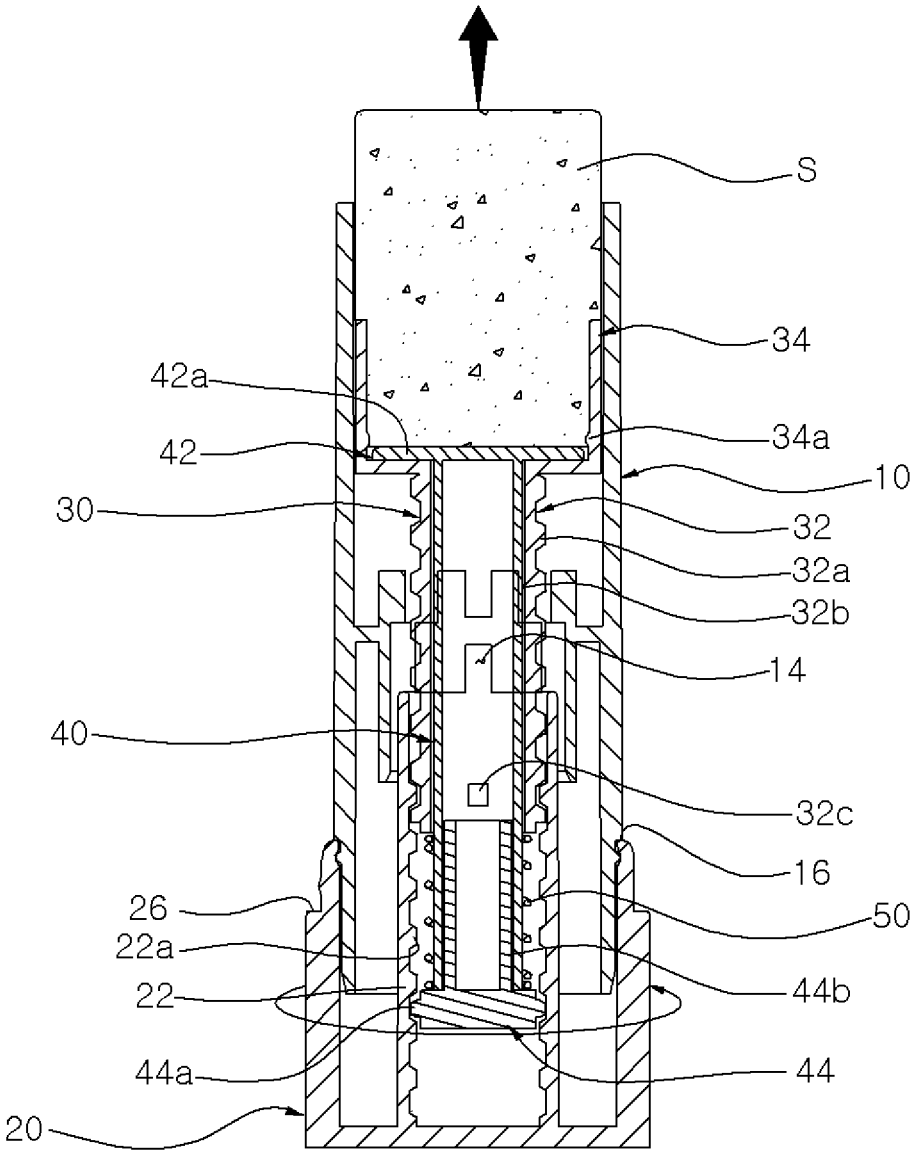
FIGS. 5 and 6 are sectional views illustrating a state in which a stick cosmetic is withdrawn to the outside by rotating a rotary body according to one aspect of the present disclosure.
Figure 6:
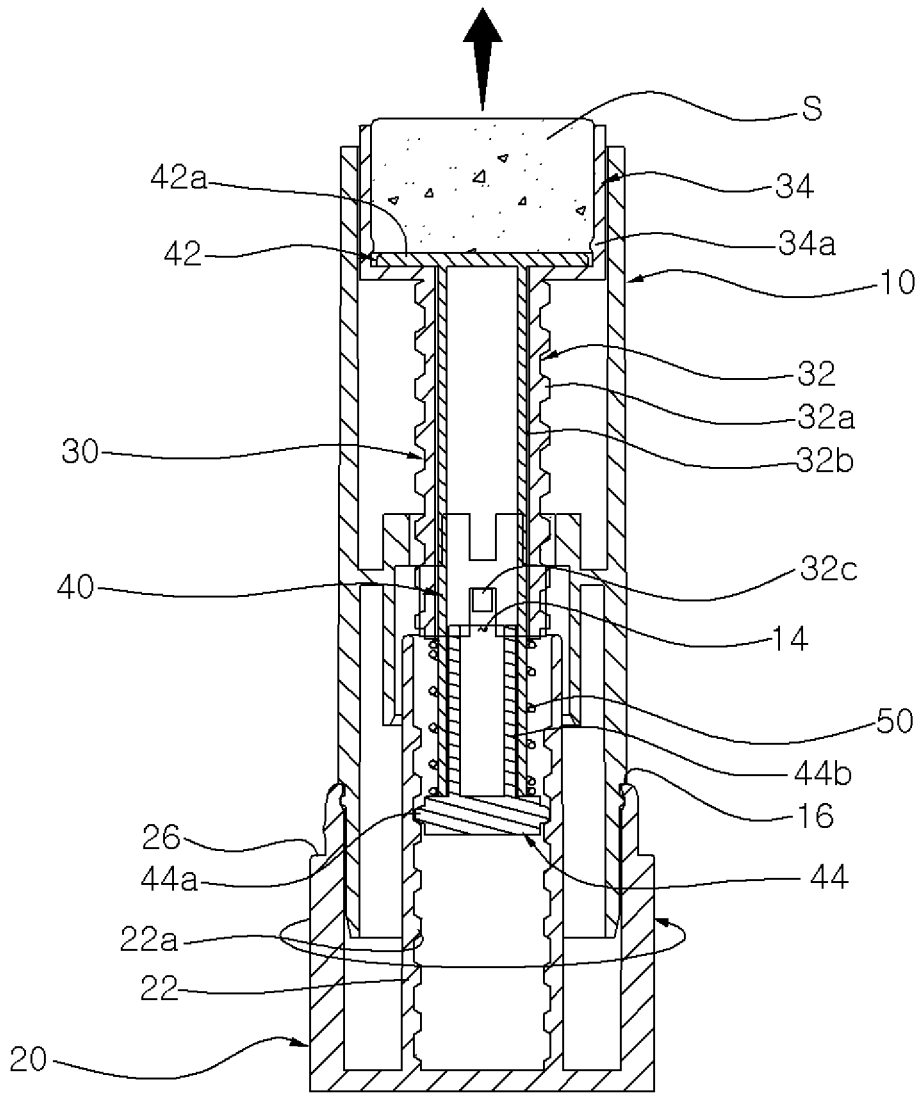
Figure 7:
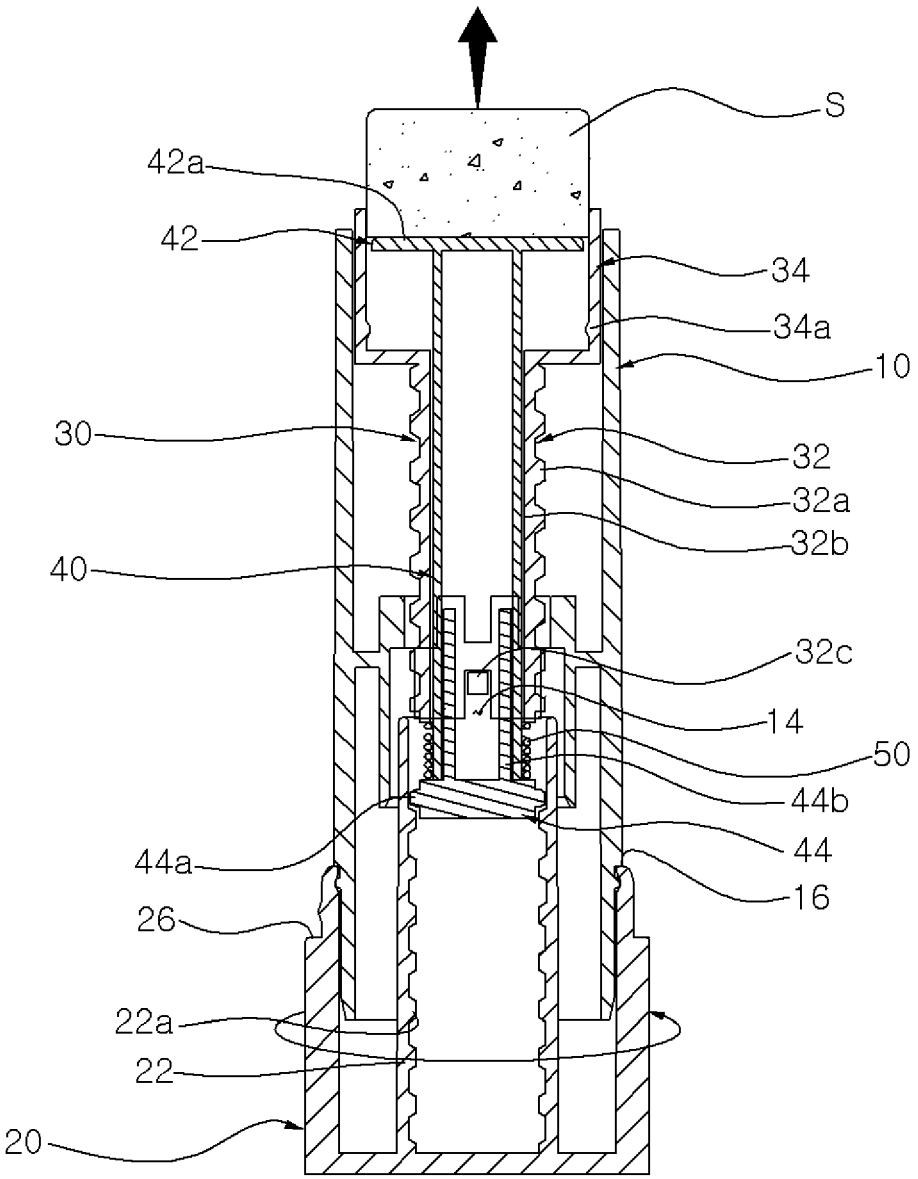
FIG. 7 is a sectional view illustrating a state in which the remaining amount of stick cosmetics remaining in an elevation member is withdrawn to the outside by further rotating a rotary body according to one aspect of the present disclosure.

FIG. 4 is a sectional view illustrating a state in which a cover is separated from a rotary body according to one aspect of the present disclosure, FIGS. 5 and 6 are sectional views illustrating a state in which a stick cosmetic is withdrawn to the outside by rotating a rotary body according to one aspect of the present disclosure, and FIG. 7 is a sectional view illustrating a state in which the remaining amount of stick cosmetics remaining in an elevation member is withdrawn to the outside by further rotating a rotary body according to one aspect of the present disclosure.

As shown in FIG. 4, in order to use the stick-type cosmetic container according to one aspect of the present disclosure, the cover 60 is firstly separated from the rotary body 20 to expose the main body 10 to the outside.

Thereafter, as shown in FIG. 5, if a user rotates the rotary body 20 in one direction by using one hand while holding the main body 10 with the other hand, the rotary body 20 is rotated, but the rotation of the elevation member 30 is limited due to the main body 10 held by the user, and the rotation of the remaining-amount withdrawal member 40 is limited by the elevation member 30. Thus, the elevation screw thread 32*a* of the elevation member 30 and the screw protrusion 44*a* of the remaining-amount withdrawal member 40 move upward together along the rotary screw thread 22*a* of the rotary body 20, so that the stick cosmetic S provided in the elevation member 30 is gradually withdrawn to the outside through the one open side of the main body 10.

After that, the stick cosmetic S withdrawn out of the main body 10 is applied to the skin, and then, the rotary body 20 is rotated in the opposite direction to move the stick cosmetic S into the inside of the main body 10, and the cover 60 is coupled with the rotary body 20 while wrapping the main body 10 to close the main body 10.

Meanwhile, as shown in FIG. 6, when it is necessary to use the remaining amount of the stick cosmetic S that is left inside the elevation member 30 because the stick cosmetic S attached to the elevation member 30 is almost used, the user rotates the rotary body 20. Thus, the elevation member 30 and the remaining-amount withdrawal member 40 linearly move simultaneously along the longitudinal direction of the main body 10, and then the elevation member 30 deviates from the rotary body 20 so that the fixing protrusion 32*c* of the elevation member 30 is inserted into the fixing groove 14 of the main body 10.

Then, when the rotary body 20 is further rotated, the elevation member 30 is no longer moved up due to the main body 10, but the screw protrusion 44*a* of the 10) remaining-amount withdrawal member 40 moves along the rotary screw thread 22*a* of the rotary body 20, so that only the remaining-amount withdrawal member 40 is moved up in the elevation member 30.

At this point, in a state in which the withdrawal plate 42*a* of the remaining-amount withdrawal member 40 is fixed in an undercut coupling state with the stopper protrusion 34*a* of the elevation member 30, the withdrawal plate 42*a* moves over the stopper protrusion 34*a* when the remaining-amount withdrawal member 40 moves upward. Continuously, as shown in FIG. 7, the elastic member 50 installed between the elevation member 30 and the remaining-amount withdrawal member 40 is compressed and the remaining-amount withdrawal member 40 is elastically moved vertically to push the remaining amount of the stick cosmetic S that is left in the plate portion 34 of the elevation member 30 to the outside.

Therefore, the operations of the elevation member 30 and the remaining-amount withdrawal member 40 are continuously performed only by the rotation of the rotary body 20, so that the user can conveniently use all the remaining amount of the stick cosmetic S. In addition, the user can recognize with naked eyes that the remaining amount of the stick cosmetic S that is left in the plate portion 34 has started to be withdrawn, and the operating feeling is improved in the process of withdrawing the remaining amount of the stick cosmetic S.

Hereinafter, a stick-type cosmetic container according to another aspect of the present disclosure will be described in detail with reference to FIGS. 8 to 11.

Figure 8:
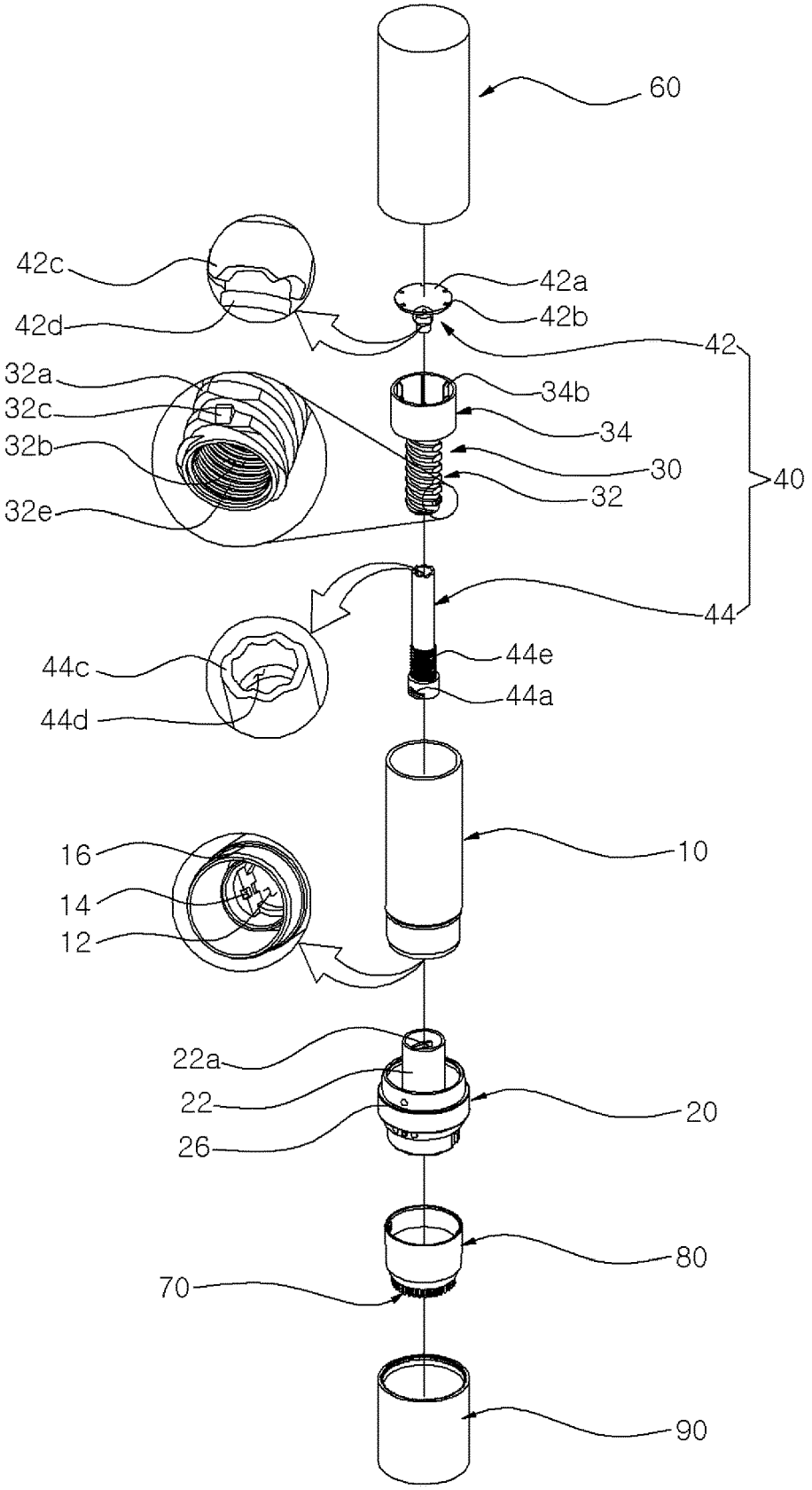
FIG. 8 is an exploded perspective view of a stick-type cosmetic container according to another aspect of the present disclosure.
Figure 9:
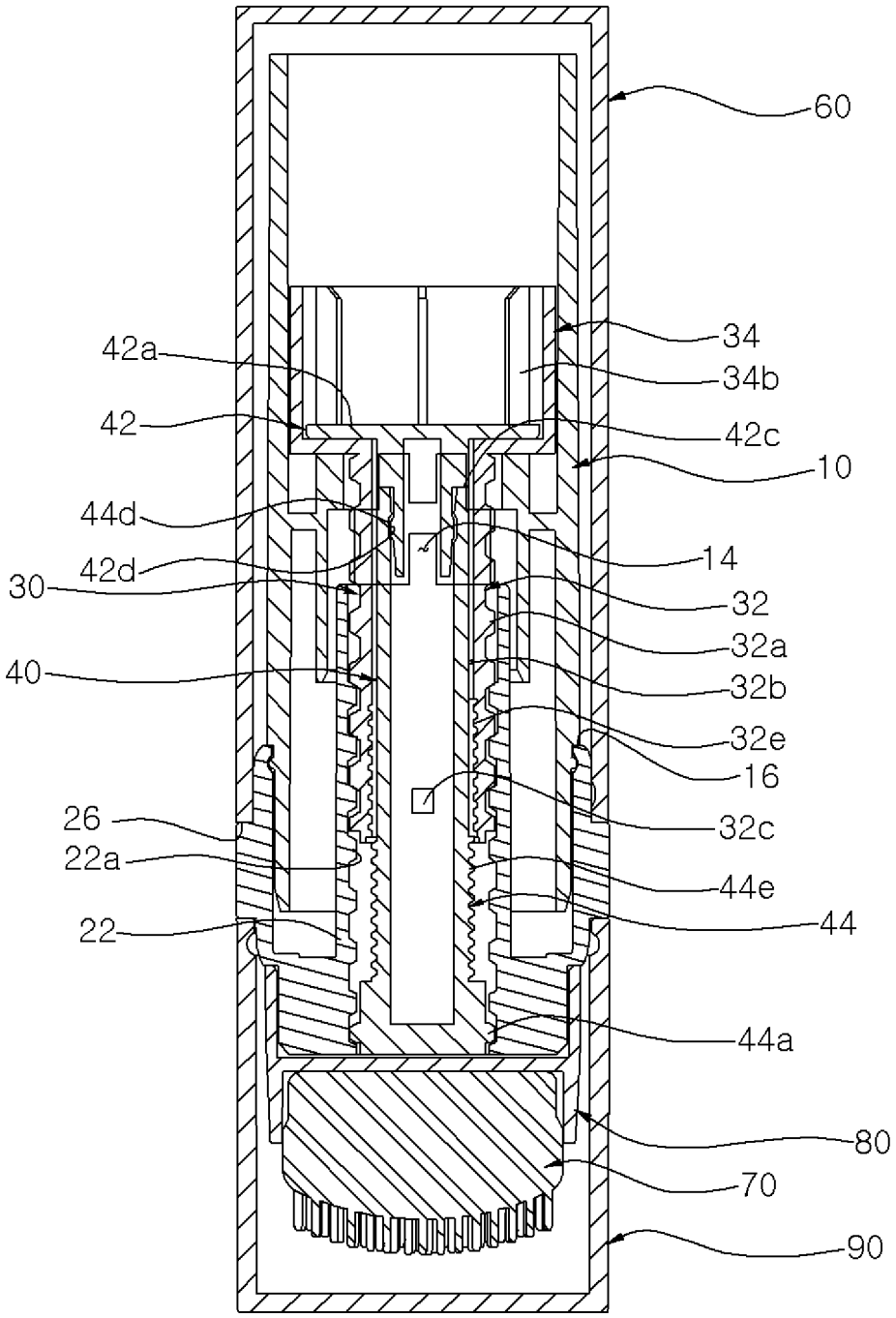
FIG. 9 is a sectional view of a stick-type cosmetic container according to another aspect of the present disclosure.

FIG. 8 is an exploded perspective view of a stick-type cosmetic container according to another aspect of the present disclosure, and FIG. 9 is a sectional view of a stick-type cosmetic container according to another aspect of the present disclosure.

As shown in the drawings, the stick-type cosmetic container according to another aspect of the present disclosure may include a main body 10, a rotary body 20, an elevation member 30, and a remaining-amount withdrawal member 40.

In the stick-type cosmetic container according to another aspect of the present disclosure, the remaining-amount withdrawal member 40 moves to the inside of the elevation member 30 as the elevation member 30 and the remaining-amount withdrawal member 40 are screw-coupled to each other, so that the remaining-amount withdrawal member 40 pushes the stick cosmetic S remaining inside the elevation member 30 to the outside. The structure of the main body 10, the rotary body 20, and the cover 60, and the structure for simultaneous moving up and down the elevation member 30 and the remaining-amount withdrawal member 40 are the same as those in the stick-type cosmetic container according to one aspect of the present disclosure described above, so detailed description thereof will be omitted.

As shown in FIG. 8, a first screw thread 32*e* may be formed on the inner periphery of the elevation member 30, and a second screw thread 44*e* may be formed on the outer periphery of the remaining-amount withdrawal member 40 such that they can be screw-coupled to each other. Accordingly, the remaining-amount withdrawal member 40 is moved to the inside of the elevation member 30 to slowly withdraw the remaining amount of the stick cosmetic S to the outside. That is, as the elevation screw thread 32*a* formed on the outer periphery of the elevation member 30 is screw-coupled with the rotary screw thread 22*a* of the rotary body 22, the elevation function of the elevation member 30 can be performed in the main body 10. In addition, as the first screw thread 32*e* formed on the lower inner periphery of the elevation member 30 is screw-coupled with the second screw thread 44*e* of the remaining-amount withdrawal member 40, the elevation function of the remaining-amount withdrawal member 40 can be performed in the elevation member 30. Further, the elevation screw thread 32*a* and the first screw thread 32*e* of the elevation member 30 are formed in opposite directions to each other, so they are screw-coupled stepwise with the rotary screw thread 22*a* and the second screw thread 44*e*. Due to the above elevation structure, the remaining amount of the stick cosmetic S can be stably withdrawn, and the user can recognize the withdrawal operation with the naked eyes.

In this case, the screw thread pitch (a distance between adjacent screw threads measured in the axial direction in parallel to each other) of the first and second screw threads 32*e* and 44*e* may determine the elevation height, that is, the elevation speed of the remaining-amount withdrawal member 40, so the screw thread pitch of the first and second screw threads 32*e* and 44*e* can be variously changed in consideration of the elevation speed of the stick cosmetic S by the remaining-amount withdrawal member 40. For example, if the interval between the adjacent screw threads of the first and second screw threads 32*e* and 44*e* is relatively large, the remaining-amount withdrawal member 40 may move up higher when the elevation member 30 and the remaining-amount withdrawal member 40 are screw-coupled by the rotation of the rotary body 20 in a predetermined section, so that the elevation speed of the stick cosmetic S is increased. Conversely, if the interval between the adjacent screw threads of the first and second screw threads 32*e* and 44*e* is relatively small, the remaining-amount withdrawal member 40 may move up lower when the elevation member 30 and the remaining-amount withdrawal member 40 are screw-coupled by the rotation of the rotary body 20 in a predetermined section, so that the elevation speed of the stick cosmetic S is slow.

As shown in FIG. 9, the withdrawal portion 42 and the operation portion 44 of the remaining-amount withdrawal member 40 are separately formed and coupled to each other, and the first control protrusion 42*c* and the second control protrusion 44*c* may be formed in contact portions between the withdrawal portion 42 and the operation portion 44, respectively, to be engaged with each other. That is, curved protrusions such as saw teeth are repeatedly disposed along the periphery on the lower part of the withdrawal portion 42 and the upper end of the operation portion 44 of the remaining-amount withdrawal member 40 such that they are engaged with each other, and a fastening protrusion 42*d* and a fastening groove 44*d* are formed on the lower outer periphery of the withdrawal portion 42 and the upper inner periphery of the operation portion 44 such that they are coupled to each other. Thus, the withdrawal portion 42 is prevented from being separated from the operation portion 44 due to the fastening structure of the fastening protrusion 42*d* the fastening groove 44*d*, and at the same time, gradually moved up due to the engagement structure of the first control protrusion 42*c* and the second control protrusion 44*c*. Accordingly, it is possible not only to limit the reverse rotation of the withdrawal portion 42, but also to improve the feeling of use in the process of withdrawing the remaining amount of the stick cosmetic S.

Meanwhile, a cosmetic applicator 70 and an applicator cover 90 for protecting the cosmetic applicator 70 may be further coupled on the opposite side of the main body 10 about the rotary body 20.

The cosmetic applicator 70 is a kind of tools used to apply cosmetics to the skin, and may include a brush or a puff. In addition, the cosmetic applicator 70 can be provided in various forms according to the type of the stick cosmetic S contained in the stick-type cosmetic container or the makeup method. Further, the cosmetic applicator 70 may be coupled to the rotary body 20 by a connection member 80. In this case, cosmetic applicator 70 may be detachably coupled to the connection member 80 so that it can be exchanged.

The applicator cover 90 is detachably coupled to the rotary body 20 while surrounding the cosmetic applicator 70. In the drawing of the stick-type cosmetic container according to another aspect of the present disclosure, the rotary body 20 and the applicator cover 90 are shown as to be fastened by the protrusion and groove, but the present disclosure is not limited thereto. Various types of fastening structures such as undercut coupling, press fitting coupling, magnetic coupling, etc. may be used so long as the applicator cover 90 can be easily detached from the rotary body 20.

Figure 10:
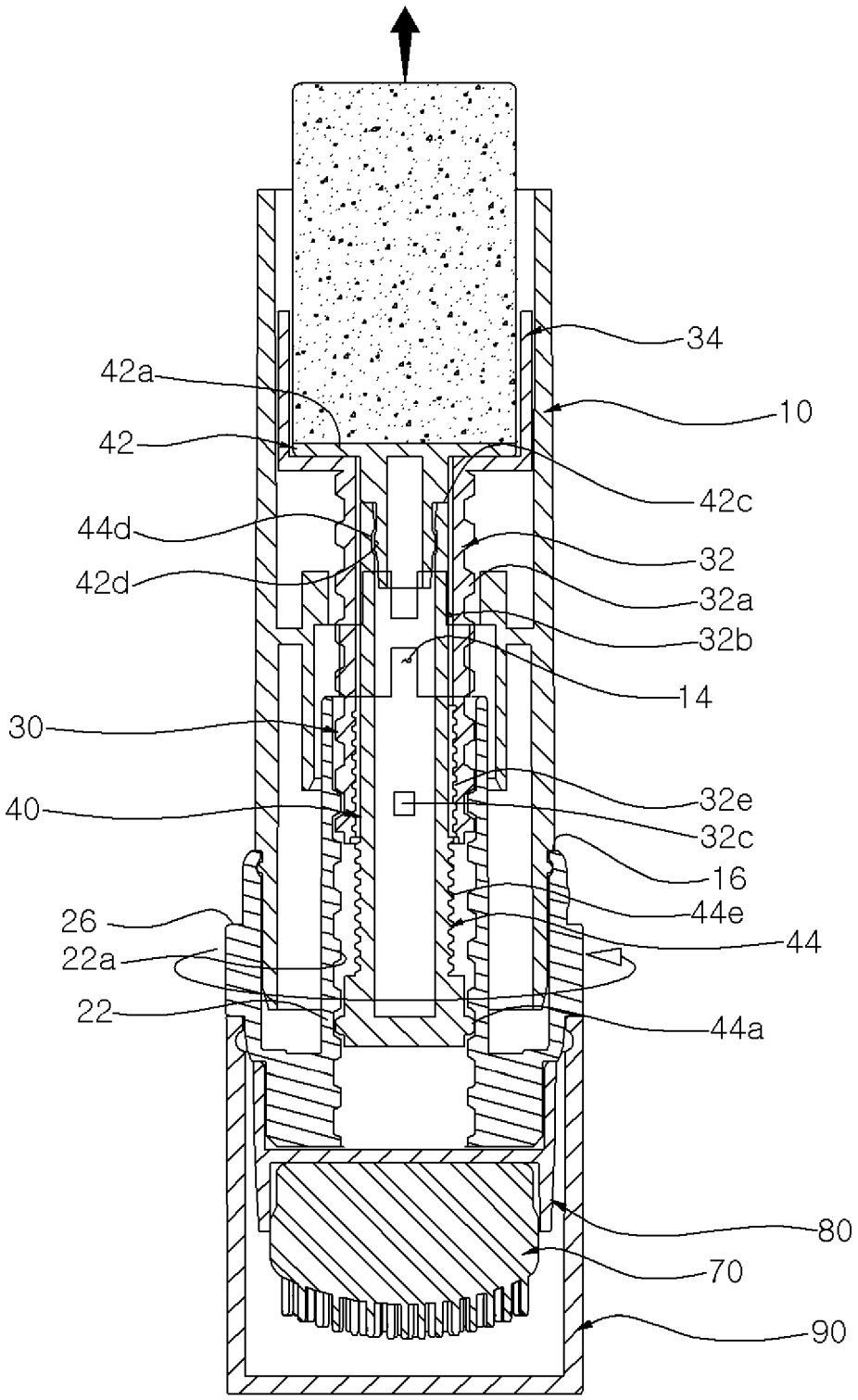
FIG. 10 is a sectional view illustrating a state in which a stick cosmetic is withdrawn to the outside by rotating a rotary body according to another aspect of the present disclosure.
Figure 11:
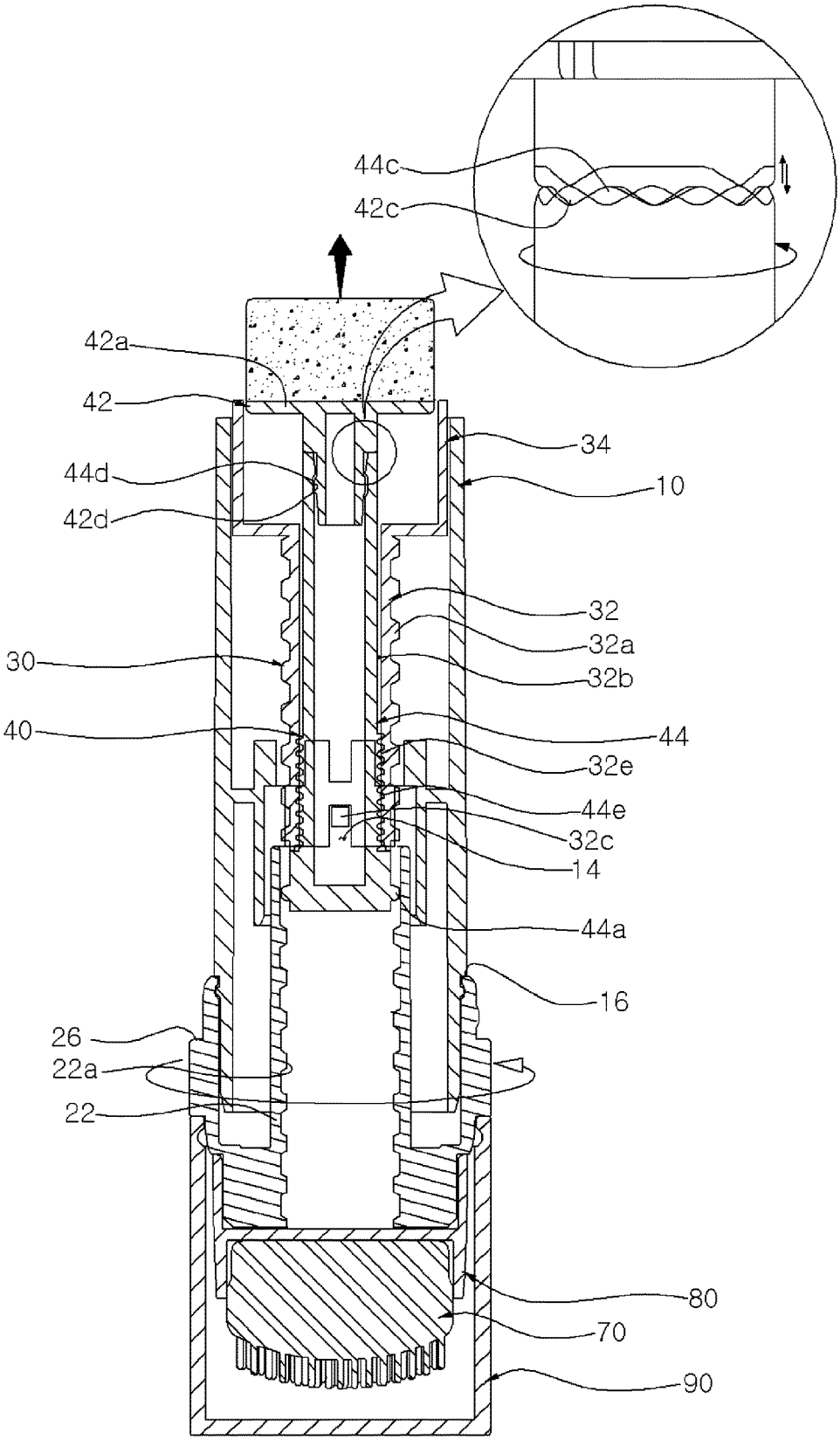
FIG. 11 is a sectional view illustrating a state in which the remaining amount of stick cosmetics remaining in an elevation member is withdrawn to the outside by further rotating a rotary body according to another aspect of the present disclosure.

FIGS. 10 and 11 are views illustrating an operation process of a stick-type cosmetic container according to another aspect of the present disclosure, and the process of using a stick-type cosmetic container according to another aspect of the present disclosure will be described with reference to FIGS. 10 and 11.

FIG. 10 is a sectional view illustrating a state in which a stick cosmetic is withdrawn to the outside by rotating a rotary body according to another aspect of the present disclosure, and FIG. 11 is a sectional view illustrating a state in which the remaining amount of stick cosmetics remaining in an elevation member is withdrawn to the outside by further rotating a rotary body according to another aspect of the present disclosure.

As shown in FIG. 10, if a user rotates the rotary body 20 in one direction by using one hand while holding the main body 10 with the other hand, the rotary body 20 is rotated, but the rotation of the elevation member 30 is limited due to the main body 10 held by the user, and the rotation of the remaining-amount withdrawal member 40 is limited by the elevation member 30. Thus, the elevation screw thread 32*a* of the elevation member 30 and the screw protrusion 44*a* of the remaining-amount withdrawal member 40 move upward together along the rotary screw thread 22*a* of the rotary body 20, so that the stick cosmetic S provided in the elevation member 30 is gradually withdrawn to the outside through the one open side of the main body 10.

After that, the makeup is performed by using the stick cosmetic S withdrawn out of the main body 10, and then, the rotary body 20 is rotated in the opposite direction to move the stick cosmetic S into the inside of the main body 10, and the cover 60 is coupled with the rotary body 20 while wrapping the main body 10 to close the main body 10.

Meanwhile, as shown in FIG. 11, when it is necessary to use the remaining amount of the stick cosmetic S that is left inside the elevation member 30 because the stick cosmetic S attached to the elevation member 30 is almost used, the user rotates the rotary body 20. Thus, the elevation member 30 and the remaining-amount withdrawal member 40 linearly move simultaneously along the longitudinal direction of the main body 10, and then the elevation member 30 deviates from the rotary body 20 so that the fixing protrusion 32*c* of the elevation member 30 is inserted into the fixing groove 14 of the main body 10.

Then, when the rotary body 20 is further rotated, the elevation member 30 is no longer moved up due to the main body 10, but the screw protrusion 44*a* of the remaining-amount withdrawal member 40 temporally moves upward along the rotary screw thread 22*a* of the rotary body 20, so that the second screw thread 44*e* of the remaining-amount withdrawal member 40 and the first screw thread 32*e* of the elevation member 30 are screw-coupled together. Accordingly, the elevation member 30 pulls up the remaining-amount withdrawal member 40, so that the remaining-amount withdrawal member 40 pushes up the stick cosmetic S that is left inside the plate portion 34 so that the stick cosmetic S is withdrawn to the outside. At this point, as the operation portion 44 of the remaining-amount withdrawal member 40 is rotated, the protrusion of the second control protrusion 44*c* formed on the operation portion 44 slightly pushes upward the protrusion of the first control protrusion 42*c* formed on the withdrawal portion 42 and then the first control protrusion 42*c* and the second control protrusion 44*c* are engaged again. The above process is repeated so that the withdrawal portion 42 is moved up step by step.

Although the disclosure has been described with the particulars such as specific elements, the limited embodiments, and the drawings, which are provided only to help comprehensive understanding of the disclosure, and the present disclosure is not limited to the embodiments. It is obvious to those skilled in the art that various changes and modifications may be made. Therefore, the spirit of the present disclosure should not be limited to the aforementioned embodiments, and the following claims as well as all modifications or variations belonging to the equivalents of the claims will be within the scope of the disclosure.

[Description of Reference Symbols]

| | |
|---|---|
| 10: | main body |
| 12: | anti-rotation hole |
| 20: | rotary body |
| 22: | coupling portion insertion tube |
| 22a: | rotary screw thread |
| 30: | elevation member |
| 32: | screw coupling portion |
| 32a: | elevation screw thread |
| 32e: | first screw thread |
| 34: | plate portion |
| 34a: | stopper protrusion |
| 34b: | fixing plate |
| 40: | remaining-amount withdrawal member |
| 42: | withdrawal portion |
| 42a: | withdrawal plate |
| 42c: | first control protrusion |
| 44: | operation portion |
| 44a: | screw protrusion |
| 44c: | second control protrusion |
| 44e: | second screw thread |
| 50: | elastic member |
| 60: | cover |
| 70: | cosmetic applicator |
| 80: | connection member |
| 90: | Applicator cover |
| S: | stick cosmetic |

The invention claimed is:

1. A stick-type cosmetic container comprising:

a main body;

a rotary body which is rotatably coupled to the main body and has a rotary screw thread formed thereon;

an elevation member, which is coupled to an inner side of the main body and moves up and down, provided with a stick cosmetic, and formed with an elevation screw thread; and a remaining-amount withdrawal member which is coupled to the elevation member so as to push the stick cosmetic outward, and formed with a screw protrusion, wherein a fixing groove is formed in the main body, and a fixing protrusion is formed in the elevation member so that the fixing protrusion is inserted into the fixing groove.

2. The stick-type cosmetic container of claim 1, wherein the elevation member includes a plate portion to which the stick cosmetic is attached and a screw coupling portion screw-coupled to the rotary body, and a stopper protrusion protrudes from an inside of the plate portion to limit a movement of the remaining-amount withdrawal member.

3. The stick-type cosmetic container of claim 1, wherein the remaining-amount withdrawal member includes a withdrawal portion provided with a withdrawal plate to push the stick cosmetic to an outside and an operation portion for moving the withdrawal portion within the elevation member.

4. The stick-type cosmetic container of claim 3, wherein the withdrawal portion and the operation portion of the remaining-amount withdrawal member are formed separately from each other and coupled to each other, and a first control protrusion and a second control protrusion are formed at portions where the withdrawal portion makes contact with the operation portion, respectively, and are engaged with each other.

5. The stick-type cosmetic container of claim 1, wherein an elastic member is installed between the elevation member and the remaining-amount withdrawal member, and the elastic member comes in close contact with an end of the elevation member while surrounding at least a portion of the remaining-amount withdrawal member to provide elasticity between the elevation member and the remaining-amount withdrawal member.

6. The stick-type cosmetic container of claim 1, wherein a first screw thread is formed on an inner periphery of the elevation member, a second screw thread is formed on an outer periphery of the remaining-amount withdrawal member, and the first screw thread is screw-coupled with the second screw thread so that the remaining-amount withdrawal member moves along an inside of the elevation member.

7. The stick-type cosmetic container of claim 1, wherein a cosmetic applicator is further coupled to an opposite side of the main body about the rotary body.

8. A stick-type cosmetic container comprising:

a main body;

a rotary body which is rotatably coupled to the main body and has a rotary screw thread formed thereon;

an elevation member, which is coupled to an inner side of the main body and moves up and down, provided with a stick cosmetic, and formed with an elevation screw thread; and a remaining-amount withdrawal member which is coupled to the elevation member so as to push the stick cosmetic outward, and formed with a screw protrusion, wherein an elastic member is installed between the elevation member and the remaining-amount withdrawal member, and the elastic member comes in close contact with an end of the elevation member while surrounding at least a portion of the remaining-amount withdrawal member to provide elasticity between the elevation member and the remaining-amount withdrawal member.

9. A stick-type cosmetic container comprising:

a main body;

a rotary body which is rotatably coupled to the main body and has a rotary screw thread formed thereon;

an elevation member, which is coupled to an inner side of the main body and moves up and down, provided with a stick cosmetic, and formed with an elevation screw thread; and a remaining-amount withdrawal member which is coupled to the elevation member so as to push the stick cosmetic outward, and formed with a screw protrusion, wherein a first screw thread is formed on an inner periphery of the elevation member, a second screw thread is formed on an outer periphery of the remaining-amount withdrawal member, and the first screw thread is screw-coupled with the second screw thread so that the remaining-amount withdrawal member moves along an inside of the elevation member.

* * * * *